US006866595B1

(12) United States Patent
Elder et al.

(10) Patent No.: US 6,866,595 B1
(45) Date of Patent: Mar. 15, 2005

(54) PLAYING FIELD OBSTACLE DEVICE

(75) Inventors: James C. Elder, Richardson, TX (US); Peter-Matias T. Lopez, Garland, TX (US)

(73) Assignee: The Soccer Wall Company, Carrollton, TX (US)

( * ) Notice: Subject to any disclaimer, the term of this patent is extended or adjusted under 35 U.S.C. 154(b) by 0 days.

(21) Appl. No.: 10/744,251

(22) Filed: Dec. 22, 2003

(51) Int. Cl.[7] ..... A63B 69/00
(52) U.S. Cl. ..... 473/446; 473/444
(58) Field of Search ..... 473/446, 440–444, 473/438, 422, 505–512; 273/401, 402; 43/2, 3

(56) References Cited

U.S. PATENT DOCUMENTS

| | | | | | |
|---|---|---|---|---|---|
| 4,815,784 | A | | 3/1989 | Zheng | |
| 4,869,503 | A | * | 9/1989 | Grasso | 473/444 |
| 4,934,938 | A | * | 6/1990 | Orlandi et al. | 473/444 |
| 5,116,273 | A | | 5/1992 | Chan | |
| 5,397,130 | A | * | 3/1995 | Brown | 273/348 |
| 5,527,185 | A | | 6/1996 | Davis | |
| 5,928,093 | A | | 7/1999 | Lai | |
| 6,012,994 | A | * | 1/2000 | Beluse | 473/446 |
| 6,266,904 | B1 | * | 7/2001 | Zheng | 40/604 |
| 6,374,530 | B1 | * | 4/2002 | Mierau | 43/3 |

OTHER PUBLICATIONS

Web page from www.soccer.com, Kwik Goal Free Kick Man #16211, p. 1, May 14, 2003.

Web page from www.soccer.com, Goal Sporting Goods Goal Wall #512, P. 1, May 14, 2003.

Web page from www.soccerrom.com, SorerROM's Soccer-Mall: Field Equipment, Performance Line Carry Bag, p. 1, May 17, 2003.

Photos of obstacle devices, no date listed.

* cited by examiner

*Primary Examiner*—Gregory Vidovich
*Assistant Examiner*—M. Chambers
(74) *Attorney, Agent, or Firm*—Grady K. Bergen

(57) ABSTRACT

An obstacle device for use on a playing field is formed from an elongate support member. A frame member in the form of a resilient, flexible hoop is coupled to the support member. The frame member has an expanded configuration that defines an expanded frame area. The frame member is resiliently deformable to a collapsed configuration that defines a collapsed frame area that is less than the expanded frame area. A layer of fabric material is attached to the frame member so that the fabric material is spread by the frame when the frame is in the expanded configuration.

16 Claims, 4 Drawing Sheets

FIG. 1
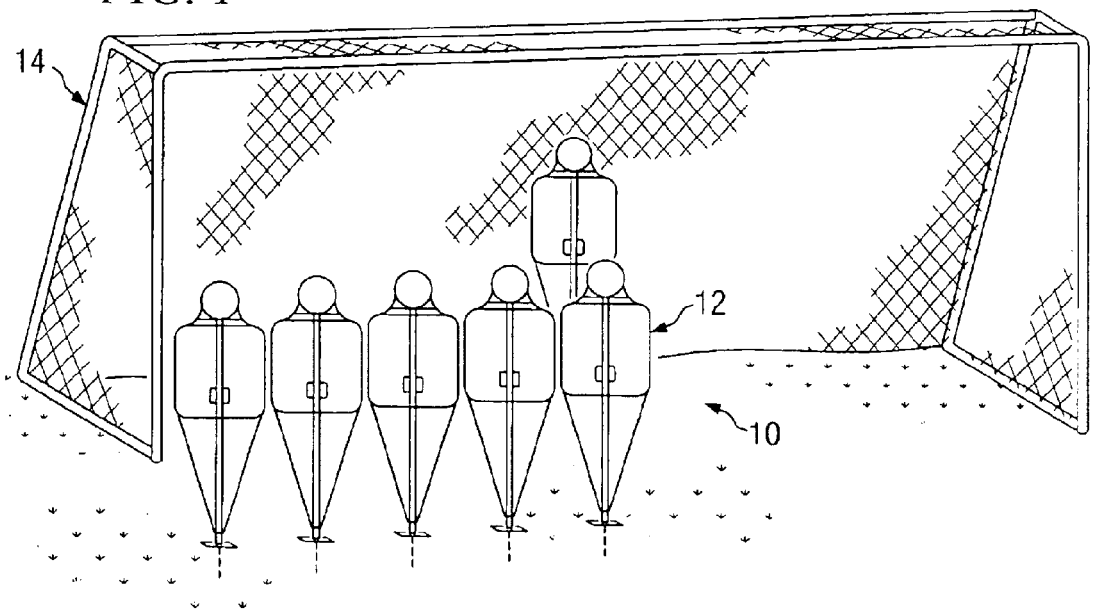
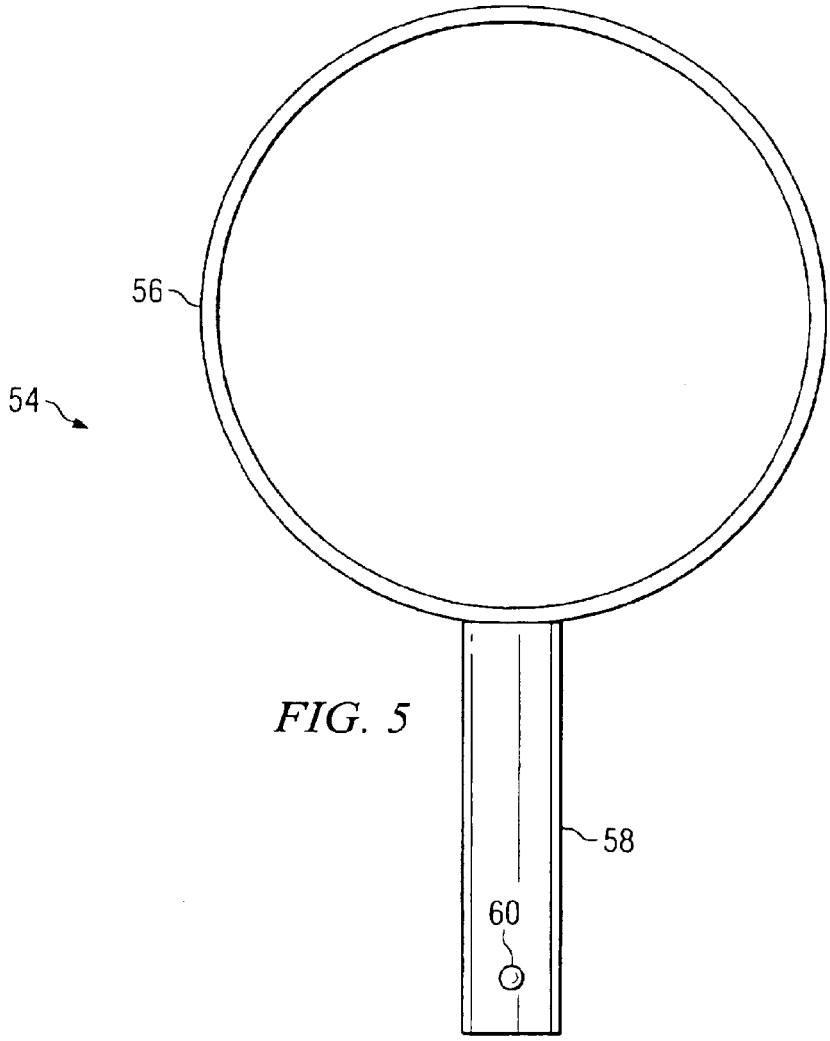
FIG. 5

PLAYING FIELD OBSTACLE DEVICE

TECHNICAL FIELD

The invention relates generally to practice devices for sports activities.

BACKGROUND

In soccer, when certain fouls are committed against the offensive team, a "free kick" may be awarded. In such instances, the ball is positioned at a distance from the goal and an offensive player is allowed a "free kick" to attempt to kick the ball into the goal. Players of the defending team are allowed to stand at a distance from the kicker to form a blocking wall or obstacle between the kicker and the goal, making it more difficult for the kicker to score a goal.

During practice of such free kicks, one or more non-kicking players may be used to form the blocking wall. This, however, prevents the non-kicking players from participating in more beneficial practice exercises.

Blocking walls of various designs have been used in the past. These devices are non-collapsible and may be quite heavy, making them unwieldy and difficult to transport and store.

BRIEF DESCRIPTION OF THE DRAWINGS

For a more complete understanding of the present invention, reference is now made to the following descriptions taken in conjunction with the accompanying figures, in which:

FIG. 1 is a perspective view of a playing field employing a plurality of obstacle devices constructed in accordance with the invention;

FIG. 5 is a front elevational view of a head piece of the device of FIG. 2.

DETAILED DESCRIPTION

Referring to FIG. 1, a blocking wall 10 formed from obstacle devices 12 is positioned in front of a soccer goal 14 located on a playing field to serve as an obstacle during practice kicks. The wall 10 may be formed by positioning the obstacle devices 12 in a side-by-side relationship, as shown. Other configurations could be used, as well, such as a spaced apart or staggered configuration for use as a dribble course wherein a player moves between the devices. Although the wall 10 and obstacle devices 12 are shown being used in practice for soccer, it should be apparent to those skilled in the art the devices 12 may be useful and have application to other sports and activities, as well, and should not be limited to any particular use or activity.

Figure 2:
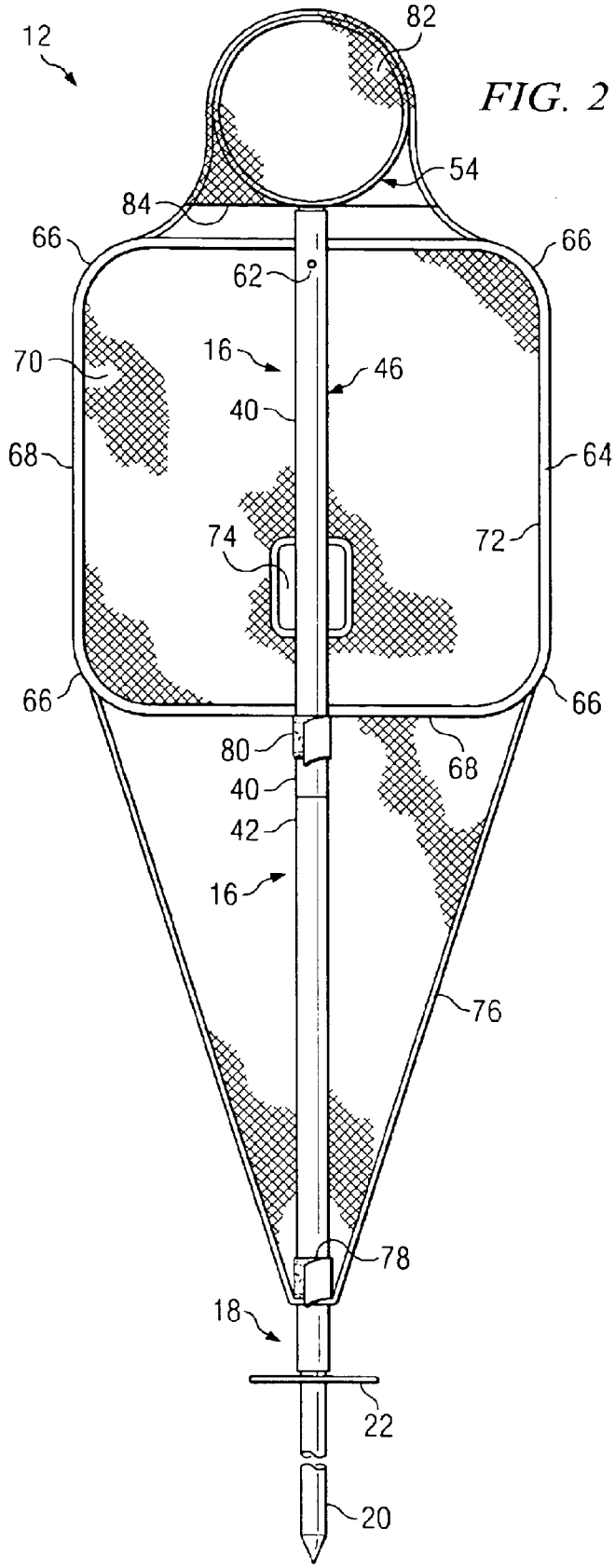
FIG. 2 is a front elevational view of one of the devices of FIG. 1.

Referring to FIG. 2, the obstacle device 12 includes a support member 16, which is held by a base 18 for holding the support member 16 in a generally vertical or upright manner with respect to the playing field.

Figure 3A:
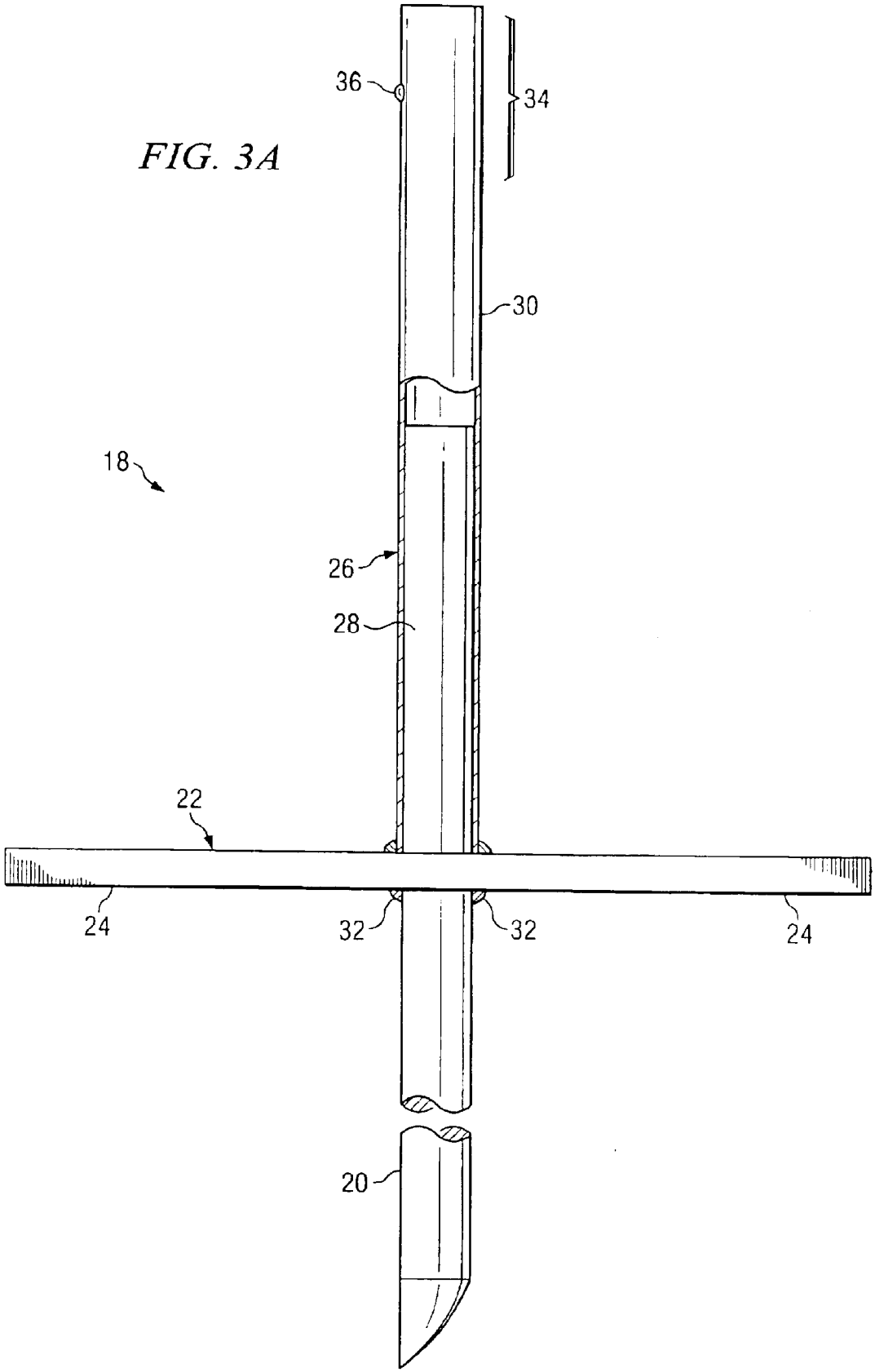
FIG. 3A is a front elevational view of a base of the device of FIG. 2.
Figure 3B:
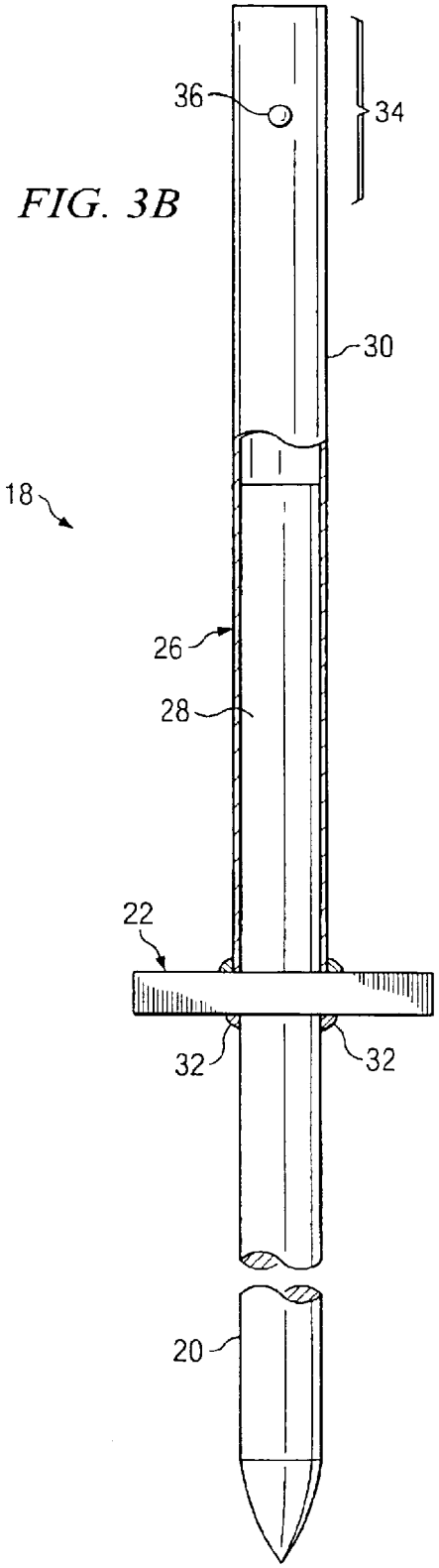
FIG. 3B is a side elevational view of the base of FIG. 3A.

Referring to FIG. 3, the base 18 may include one or more downwardly extending stake members 20. The stake member(s) 20 has a base crossbar or member 22, which may be oriented generally transverse to the stake member 20. As shown in the present embodiment, the cross member 22 may be a generally flat, rectangular member that is oriented in a plane generally perpendicular to the single stake member 20, with the stake member 20 being generally centered on the cross member 22. The cross member 22 may have other configurations, however.

The sides 24 of the cross member 22 that project outward from the stake member 20 may serve as steps or contact areas wherein a user may place their foot to facilitate insertion of the stake 10 of the base 18 into the ground or other support media. The end of the stake member 20 may also be pointed or tapered to facilitate such insertion. The stake member or members 20 should project a sufficient distance such that the supported obstacle device 12 cannot be readily dislodged or knocked over during normal use. The cross member 22 may also serve as a stop for limiting the staking or insertion of the stake member 20 into the ground and may further stabilize the base 18 once it is inserted.

Extending upward from the cross member 22, opposite the stake member 20, is a neck 26 of the base 18. The neck 26 may be formed into two sections consisting of an inner member 28 and an outer member 30. The inner member 28 may be an upwardly extending continuation of the stake member 20, which may be a single piece, with the crossbar 22 being joined to midsection of the stake. The outer member 30 may be a tubular member that receives the inner member 28, and is joined thereto, such as at the welds 32. The outer member 30 may extend upwardly beyond the inner member 28 to provide a support engagement portion 34. The support engagement portion 34 is provided with a detent 36 or other releasable locking device, which may be in the form of a spring-loaded ball detent that is biased outwardly so that it projects beyond the outer surface of the engagement portion 34.

Figure 4:
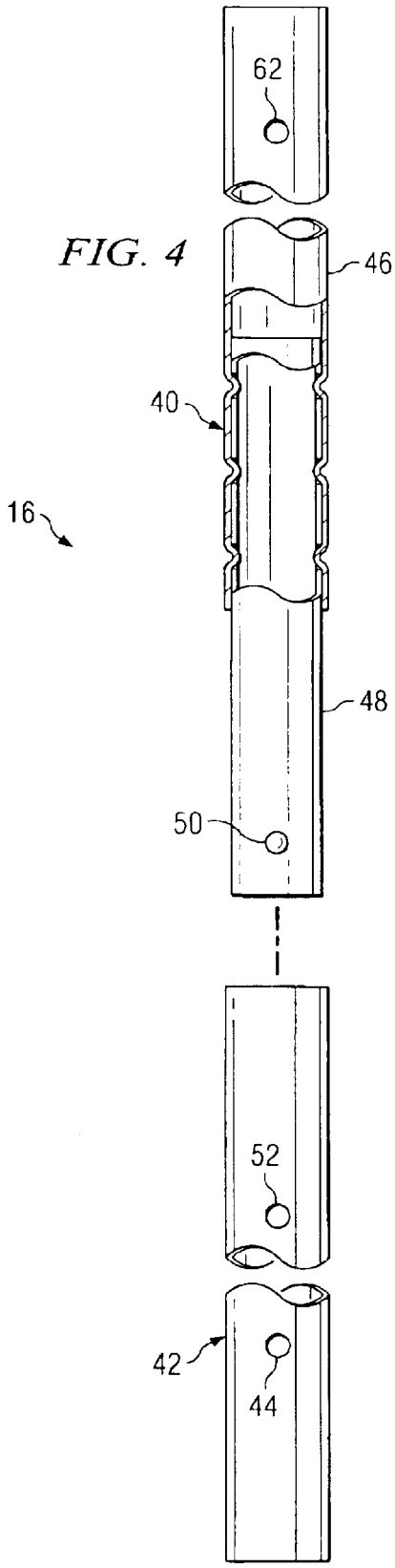
FIG. 4 is a elevational view of a support member of the device of FIG. 2.

The support member 16 may be formed in one or more sections. Referring to FIG. 4, the support member 16 is shown as being formed into upper and lower tubular sections 40, 42, respectively. The lower end of the lower tubular section 42 is, sized to fit over the support engagement portion 34 and closely receive the outer member of the base 18. One or more apertures 44 may be provided in the wall of the tubular section 42 to receive the detent 36 and to facilitate locking or coupling the lower section 42 to the base 18. Several apertures 44 may be provided along the length of the lower section 42 so that it may be positioned at different heights, if desired.

The upper section 40 may be formed as a tubular member 46, with a smaller diameter tubular member or sleeve 48 extending from the lower end of the tubular member 46. The tubular member 46 may have a diameter that is the same or approximate to the tubular section 42. The sleeve 48 is partially received within the lower end of the member 46. A portion of the sleeve 48 extends beyond the tubular member 46. The tubular member 48 may be permanently or non-permanently joined or fastened to the tubular member with fasteners, or through welding, crimping, bonding, and the like. A detent 50 or other releasable locking device, such as a spring-loaded ball detent, is provided with the sleeve 48. The detent is biased outwardly so that it projects beyond the outer surface of the sleeve 48.

The smaller tubular member 48 is sized to be closely received within the upper end of the lower tubular section 42. One or more apertures 52 is provided at the upper end of the lower section 42 to receive the detent 50 and to facilitate locking or coupling of the upper and lower sections 40, 42 together. Several apertures 52 may be provided along the length of the upper end of the lower section 42 so that the tubular sections 40, 42 may be positioned at different relative positions. In the embodiment shown, the aperture 52 and detent 50 are positioned to engage one another when the lower end of the tubular member 46 generally abuts against the upper end of the lower tubular section 42.

Referring to FIG. 5, a head piece 54 is shown. The head piece 54 includes a generally circular portion 56, which may be sized to approximate that of the head of a human. The portion 56 may be in the form of a ring with an open center or may be a solid disk-shaped piece of material. Other configurations or shapes, such as oval, rectangular, triangular, polygonal, etc., could be used for the head piece 54, as well.

A neck 58 is joined to and extends from the portion 56. The neck 58 may be formed from a tubular member that is sized to be received within the upper end of the tubular member 46 of the upper section 40 of support member 16. A detent 60 or other releasable locking device, such as a spring-loaded ball detent, may be provided with the neck 58. One or more apertures 62 (FIG. 4) may be provided in the upper end of tubular member 46 for receiving the detent 60 to facilitate locking or coupling of the head piece 54 to the support member 16. The apertures 62 may be provided along the length of thee upper end of the tubular member 46 so that the head piece 54 may be positioned at different heights.

Referring to FIG. 2, a frame member 64 is provided. The frame member 64 is in the form of a resilient, flexible hoop, which is shown in an expanded configuration that generally defines an expanded frame area. The frame member 64 may be of spring steel wire or other material that is capable of being deformed to a collapsed configuration and which may be returned to an expanded configuration without any substantial plastic or permanent deformation. The collapsed configuration defines a collapsed frame area that is less than the expanded frame area. The collapsed frame area may be one-half, one-third, one-fourth or less than that of the expanded frame area. In one embodiment, the frame member 64 may be a continuous hoop member that is collapsed by twisting the hoop member 64 into two or more smaller hoops, which may be positioned adjacent or generally concentrically with one another.

As shown in the present embodiment, the frame member 64 has an expanded configuration that is of a generally square or rectangular shape, and which may have rounded corners 66, which are joined by generally linear side edges 68. The frame member 64 may have other shapes, such as oval, rectangular, triangular, polygonal, etc., for the expanded configuration, as well.

Covering the frame member 64 is a layer of fabric cover material 70. The fabric material 70 may be attached to the frame 64 in a variety of ways, but may include a seam or sleeve 72 along its perimeter that encases or encloses the frame member 64, with the frame member 64 spreading the fabric when the frame member 64 is in the expanded configuration. The fabric 70 may include a mesh material with numerous small openings to allow the passage of air through the material. A hand opening 74 may also be provided in the fabric material 70 that is sized to allow one's hand to pass through the cover material 70. The opening 74 may generally overlay the support member 16 when the frame member 70 is coupled thereto to facilitate grasping of the support member 16 through the cover 70.

A lower skirt portion 76 of fabric material, which may be the same as that of the cover 70, is also provided. The skirt portion 76 is joined or attached to the lower end of the frame 64 and may connected to the frame cover material 70, generally along the lower side edge 68 of the frame 64. In the embodiment shown, the skirt portion 76 tapers or narrows in width towards its lower end, with the lower end of the skirt portion 76 attaching to the support member 16 near the base 18, when the support member 16 is coupled thereto. This may be accomplished through a releasable attachment device 78, such as a hook and loop fastener or Velcro® that is sewn or attached to the skirt portion 76 and engages or secures around the support member 16.

One or more additional attachment devices 80, such as a hook and loop fastener, may be provided along the length of the skirt portion 76 or fabric frame cover 70 for engagement with the support member 16 to facilitate attachment thereto.

A fabric head piece portion 82, which may be the same or similar to the fabric material as the skirt 76 or cover 70, is also provided. The portion 82 is joined or attached to the upper end of the frame 64 and may connected to the fabric cover 70. The head piece portion 82 may be formed into a pocket having an opening 84 and may be configured for receiving the head piece 54. The pocket portion 82 may also be used for receiving and storing the fabric covered frame member 62 and fabric skirt 76, as is discussed further on.

The device 12 is assembled from its various components as follows. The support member 16 is assembled by connecting the individual sections 40, 42 together. This is accomplished by inserting the sleeve 48 of the upper section 40 into the upper end of lower section 42. The sections 40, 42 may be locked together by aligning the detent 50 with the aperture 52 so that it is received therein.

The support member 16 may then be coupled to the base 18. The base 18 may initially be positioned at a desired area of the playing field on which it is to be used. The stake 20 is inserted into the ground or other support media so that it is securely held. The cross bar 22 may serve as a steps or contact areas for placing one's foot to facilitate insertion of the stake 20. The lower end of the tubular section 42 of the support member 16 is then positioned over the outer tubular member 30 of the base 18 with the engagement portion 34 inserting therein. By aligning the detent 36 of the member 301 with the aperture 44 so that it is received therein, the base 18 and support member 16 may be locked together.

The collapsed frame member 64, with the fabric cover 70 and skirt 76 may initially be stored within the pocket portion 82. Optionally, the head piece portion 54 may also be initially stored within the pocket 82. These are removed from the pocket portion 82.

The head piece 54 may be coupled to the support member 16 by inserting the neck 58 into the upper end of tubular section 40. The detent 60 of the neck 58 may be received within the aperture 62 to lock the head piece 54 to the support member.

The covered frame member 64 is expanded from its collapsed configuration, such as by untwisting the smaller hoops or otherwise, to its fully expanded configuration. The pocket portion 82 is positioned over the head piece 54, which is secured to the support member 16, so that the frame member 64 and skirt portion 76 are essentially supported by the support member 16 by means of the pocket 82. The fasteners or attachment devices 78, 80 are also used to engage the support member and secure the frame member 64 and skirt 76 to the support 16.

After use, the device 12 may be quickly and easily disassembled and collapsed to facilitate transporting and storage. To disassemble the device 12, attachment devices

78, 80 are disengaged from the support member 16 and the pocket portion 82 with attached frame 64 and skirt 76 are lifted off the head piece 54. The covered frame member 64 may then be collapsed, such as by twisting the member into smaller overlapping or concentric loops. The collapsed frame member 64 and skirt 76 may then be inserted into the pocket portion 82 and stored therein.

The head piece 54 may be removed by disengaging the detent 60 from the aperture 62 and sliding it off the support member 16. Likewise, the support member 16 may be removed from the base 18 by disengaging the detent 36 from the aperture 44 and sliding it off the engagement portion 34. The support member 16 may also be disassembled by disengaging the detent 50 from the aperture 52 and sliding the sleeve 48 out of the tubular member 42.

A carrying case or other container (not shown) may be provided with the device 12 to conveniently hold or store the various components.

During use, the device 12 is positioned at the desired area and may serve, as a blocking wall or obstacle that approximates the front profile of a human head and torso. This frees other players from serving as an obstacle or blocking wall so that they can participate in more beneficial activities. Several of the devices 12 may be utilized and: be positioned side by side or in other configurations, as may be desired.

The device is lightweight, easy to assemble and disassemble, and can be easily transported or stored without taking up large amounts of space. The opening 74 formed in the cover 70 allows the user to grasp the support member 16 at its approximate midsection through the cover so that the device 12 may be grasped from either side and carried easily from place to place while the device is in the assembled configuration.

While the invention has been shown in only some of its forms, it should be apparent to those skilled in the art that it is not so limited, but is susceptible to various, changes and modifications without departing from the scope of the invention. Accordingly, it is appropriate that the appended claims be construed broadly and in a manner consistent with the scope of the invention.

We claim:

1. An obstacle device for use on a playing field, the device comprising:

an elongate support member;

a frame member in the form of a resilient, flexible hoop coupled to the support member, the frame member having an expanded configuration that defines an expanded frame area, the frame member being resiliently deformable to a collapsed configuration that defines a collapsed frame area that is less than the expanded fame area;

a head piece coupled to the support member, the head piece and the expanded frame member approximating in shape the front profile of a human head and torso; and a layer of fabric material attached to the frame member so that the fabric material is spread by the frame when the frame is in the expanded configuration.

2. The device of claim 1, further comprising:

a base having a stake member for staking into the ground or support media of the playing field, the support member coupling to the base, whereby the support member is held by the base in a generally upright manner.

3. The device of claim 1, wherein:

the support member is formed into two sections that releasably engage one another.

4. The device of claim 1, wherein:

the head piece is removably coupled to the support member.

5. The device of claim 1, wherein:

the head piece includes a neck in the form of a tubular member and wherein the support member includes a tubular member, ad wherein one of the tubular members of the head piece and support member is inserted into the other when the head piece is coupled to the support member.

6. An obstacle device for use on a playing field comprising:

a base;

an elongate support member formed in two sections that releasably engage one another, the support member coupling to the base, whereby the support member is held in a generally upright manner when so coupled;

a frame member in the form of a resilient, flexible hoop removably coupled to the support member, the frame member having an expanded configuration that defines an expanded frame area, the frame member being resiliently deformable to a collapsed configuration that defines a collapsed frame area that is less than the expanded frame area;

a head piece coupled to the support member, wherein the head piece and the expanded frame member approximate in shape the front profile of a human head and torso; and a layer of fabric material attached to the frame member so that the fabric material is spread by the frame when the frame is in the expanded configuration.

7. The device of claim 6, wherein:

the two sections of the support member are tubular members wherein one tubular member is inserted into the other when the tubular members are engaged, and wherein the support member further includes a detent for releasably locking the tubular members together.

8. The device of claim 7, wherein:

the tubular members are telescoping tubular members that are movable between retracted and extended positions, and wherein a substantial portion of one of the tubular members is received within the other tubular member when in the retracted position.

9. The device of claim 6, wherein:

the layer of fabric includes a head-piece portion that covers the head piece.

10. The device of claim 9, wherein:

the head-piece portion includes a pocket for receiving the head piece.

11. The device of claim 9, wherein:

the pocket is configured to receive the frame member when in the collapsed configuration.

12. The device of claim 6, wherein:

the head piece has a neck that engages one of the two sections of the support member.

13. The device of claim 7, wherein:

the head piece has a neck in the form of a tubular member with one of the tubular members of the head piece and one of the two tubular section inserting into the other when the head piece is coupled to the support member.

14. The device of claim 6, wherein:

the base includes a stake member for staking into the ground or support media of the playing field.

15. An obstacle device for use on a playing field comprising:

an elongate support member formed in two tubular sections with one section inserting into the other, the support member having a detent for releasably locking the tubular sections together;

a base having a stake member for staking into the ground or support media of the playing field, the support member coupling to the base, whereby the support member is held in a generally upright manner;

a frame member in the form of a resilient, flexible hoop removably coupled to the support member, the frame member having an expanded configuration that defines an expanded frame area, the frame member being resiliently deformable to a collapsed configuration that defines a collapsed frame area that is less than the expanded frame area;

a head piece coupled to the support member, wherein the head piece and the expanded frame member approximate in shape the front profile of a human head and torso; and a layer of fabric material attached to the frame member so that the fabric material is spread by the frame when the frame is in the expanded configuration, the layer of fabric having a head-piece portion that covers the head piece.

16. The device of claim 15, wherein:

the head-piece includes a pocket for receiving the head piece; and wherein the pocket is configured to receive the frame member when in the collapsed configuration.

* * * * *